US006249202B1

(12) United States Patent
Yamada

(10) Patent No.: US 6,249,202 B1
(45) Date of Patent: Jun. 19, 2001

(54) INDUCTANCE ELEMENT

(75) Inventor: Satoru Yamada, Tokyo (JP)

(73) Assignees: Sumida Corporation; Sumida Technologies Incorporated, both of Tokyo (JP)

( * ) Notice: Subject to any disclaimer, the term of this patent is extended or adjusted under 35 U.S.C. 154(b) by 0 days.

(21) Appl. No.: 09/472,849

(22) Filed: Dec. 28, 1999

(30) Foreign Application Priority Data

Dec. 28, 1998 (JP) ..... 10-374191

(51) Int. Cl.[7] ..... H01F 27/06; H01F 27/29
(52) U.S. Cl. ..... 336/65; 336/192
(58) Field of Search ..... 336/192, 65, 198, 336/83

(56) References Cited

U.S. PATENT DOCUMENTS 4,342,143 * 8/1982 Jennings ..... 29/25.42
5,321,380 * 6/1994 Godek et al. ..... 336/232
5,463,365 * 10/1995 Iwatani et al. ..... 336/98
5,952,909 * 9/1999 Umeno et al. ..... 336/192

FOREIGN PATENT DOCUMENTS 0674328 5/1985 (JP) .
64-39612 3/1989 (JP) .
214179 4/1990 (JP) .
2101510 8/1990 (JP) .
42009 1/1992 (JP) .
4196507 7/1992 (JP) .
595010 12/1993 (JP) .

* cited by examiner

*Primary Examiner*—Anh Mai

(57) ABSTRACT

A plate-like coil formed by a metal plate is buried in a base made from an insulating material in a state in which electrode terminals and a fixing terminal of the plate-like coil are projecting from the base. The base has through-holes in which a central leg and side legs of an E-shaped core are to be inserted. The E-shaped core and an I-shaped core are mounted to the base while holding the base therebetween, and the electrode terminals and the fixing terminal projecting from the base are bent to the bottom surface of the base. Each of an electrode terminal bent portion located bottom surface portion at which the electrode terminals are to be disposed and a fixing terminal bent portion located bottom surface portion at which the fixing terminal is to be disposed is positioned upwardly from a base bottom portion, and a recessed groove is provided between the base bottom portion and each of the electrode terminal bent portion located bottom surface portion and the fixing terminal bent portion located bottom surface portion.

7 Claims, 5 Drawing Sheets

INDUCTANCE ELEMENT

BACKGROUND OF THE INVENTION AND DESCRIPTION OF THE RELATED ART

The present invention related to an inductance element used for power supply units for electronic equipment, and the like.

In recent years, to enhance the mounting density of circuit boards for miniaturizing electronic equipment, inductance elements as electronic parts have been required to be miniaturized and thinned, and further to have an electric performance allowed to carry a large current while being miniaturized and thinned.

FIG. 10 shows the structure of a related art inductance element, in which a drum core 20 around which a coil 21 is wound is fixed on a base 22, and winding terminals 21*a* of the coil are connected to terminal boards 23 mounted on the base 22. Japanese Utility Model Laid-open Nos. Sho 64-39612 and Hei 5-95010 disclose inductance elements each of which has basically the same structure as that shown in FIG. 10.

The structure shown in FIG. 10, however, has a disadvantage that since the terminal board 23 projects outwardly from the base 22, there is a fear that the terminal board 23 may be deformed only by applying a slight external force to the terminal board 23, resulting in a contact failure between the circuit board and the terminal board 23 due to bending of the terminal board 23 and disconnection of the winding terminal 21*a*.

FIG. 11 shows the structure of another related art inductance element, in which a terminal board 25 mounted on a base 24 is bent on a bottom surface 26 side of the base 24. Japanese Utility Model Publication No. Hei 2-14179 and Japanese Utility Model Laid-open No. Sho 60-74328 disclose inductance elements each of which has basically the same structure as that shown in FIG. 11. The inductance element having such a structure is advantageous in that since the terminal board 25 does not project outwardly from the base 24, it is possible to prevent occurrence of the above-described inconvenience that the terminal board 25 Is deformed when an external force is applied to the terminal board 25.

When the terminal board 25 is bent on the bottom surface 26 side of the base 24 in such a manner as to be brought into contact therewith as shown in FIG. 11, the terminal board 25 may spring downwardly out of the bottom surface 26 of the base 24, as shown by a dotted line in FIG. 11, by a so-called spring back caused by elasticity of the terminal board 25.

If there occurs such downward spring-out of the terminal board 25, it is impossible to fixedly support the inductance element at a horizontal position upon mounting the inductance element on a circuit board, and therefore, it is difficult to rigidly bond the terminal board 25 on a circuit pattern of the circuit board by soldering. Even when the base 24 is adhesively bonded to the circuit board, since the bottom surface 26 of the base 24 is floated from the surface of the circuit board, it is difficult to certainly, rigidly bond the base 24 to the circuit board, and at the worst case, the inductance element may be peeled from the surface of the circuit board.

OBJECT AND SUMMARY OF THE INVENTION

An object of the present invention is to provide an inductance element allowed to be rigidly, fixedly supported on a circuit board.

Another object of the present invention is to provide an inductance element having a thickness being small enough to meet the requirement toward thinning of electronic parts.

A further object of the present invention is to provide an inductance element capable of carrying a large current therethrough although it is of a thin type.

According to the present invention, there is provided an inductance element including: a plate-like coil formed by a metal plate as one-turn coil, the coil having a coil portion formed into a branched shape and electrode terminals extending from the branched portions of the coil portion; a base made from an insulating material, in which the plate-like coil is buried with the electrode terminals projecting from the base, the base having through-holes in which legs of a core are to be inserted; and a core mounted in such a manner as to hold the base and thereby hold the plate-like coil buried in the base so as to form a closed magnetic path; wherein the electrode terminals projecting from the base are bent on the bottom surface of the base.

When the plate-like coil is buried in the base, the electrode terminals may project outwardly from the base.

In the plate-like coil in which the electrode terminals are provided on the branched portions of the coil portion, a fixing terminal may be provided on the coil portion. In this case, like the electrode terminals, the fixing terminal may be provided in such a manner as to project outwardly from the base.

The core is generally composed of an E-shaped core and an I-shaped core, and a central leg and side legs of the E-shaped core may be inserted in through-holes formed in the base.

The electrode terminals projecting from the base may be bent with the leading ends thereof disposed on the bottom surface of the base. A base bottom surface portion at which the electrode terminals are disposed is called an "electrode terminal bent portion located bottom surface portion". In the case of providing the fixing terminal on the coil portion of the plate-like coil, the fixing terminal projecting from the base is bent with the leading end thereof disposed on the bottom surface of the base. A base surface portion at which the fixing terminal is disposed is called a "fixing terminal bent portion located bottom surface portion". Each of the remaining bottom surface portions, other than the base bottom surface portions at which the electrode terminals and the fixing terminal are disposed, is called a "base bottom portion". According to the present invention, the electrode terminal bent portion located bottom surface portion may be preferably positioned upwardly from the base bottom portion. In other words, a stepped difference is formed between the electrode terminal bent portion located bottom surface portion and the base bottom portion.

According to the present invention, a recessed groove may be preferably formed between the electrode terminal bent portion located bottom surface portion and the base bottom portion. With this configuration, when the electrode terminal having been bent along the base side surface is further bent on the base bottom surface, the leading end of the electrode terminal can be bent at an angle of 90° or more, with a result that it is possible to prevent occurrence of downward spring-out of the leading end of the electrode terminal due to spring back.

Even in the case of providing the fixing terminal on the plate-like coil, similarly, the fixing terminal bent portion located bottom surface portion may be positioned upwardly from the base bottom portion and a recessed groove may be provided between fixing terminal bent portion located bottom surface portion and the base bottom portion. With this configuration, it is possible to bent the leading end of the fixing terminal at an angle of 90° or more, and hence to prevent occurrence of downward spring-out of the fixing terminal.

According to the present invention, since the plate-like coil is integrally buried in the base and the electrode terminals projecting from the base are bent on the bottom surface of the base, it is possible to realize an inductance element having a small thickness, and hence to contribute to thinning of electronic parts.

Since the plate-like coil is configured as one-turn coil, the coil itself can be thinned. As a result, the base in which the coil is buried can be thinned and also the core holding the base can be thinned, to thereby realize an inductance element thinned as a whole.

Since the base bottom surface portions at which the electrode terminals and fixing terminal are bent and disposed are positioned upwardly from the base bottom portions and recessed grooves are provided between the above base bottom surface portions and the base bottom portions, the electrode terminals and fixing terminal do not spring downwardly out of the base bottom surface even if there occurs spring back. As a result, upon mounting the inductance element on a circuit board, it is possible to bring the inductance element into close-contact with the plane of the circuit board and rigidly, fixedly support it on the plane of the circuit board, and hence to prevent the inductance element from being slipped from the plane of the circuit board.

The present invention is also advantageous in that since the inductance element includes a plate-like coil formed by a metal plate, such an inductance element allows a large current to flow therethrough although it is of a thin type.

DETAILED DESCRIPTION OF THE PREFERRED EMBODIMENT OF THE INVENTION

Hereinafter, the present invention will be described in detail with reference to the accompanying drawings.

Figure 1:
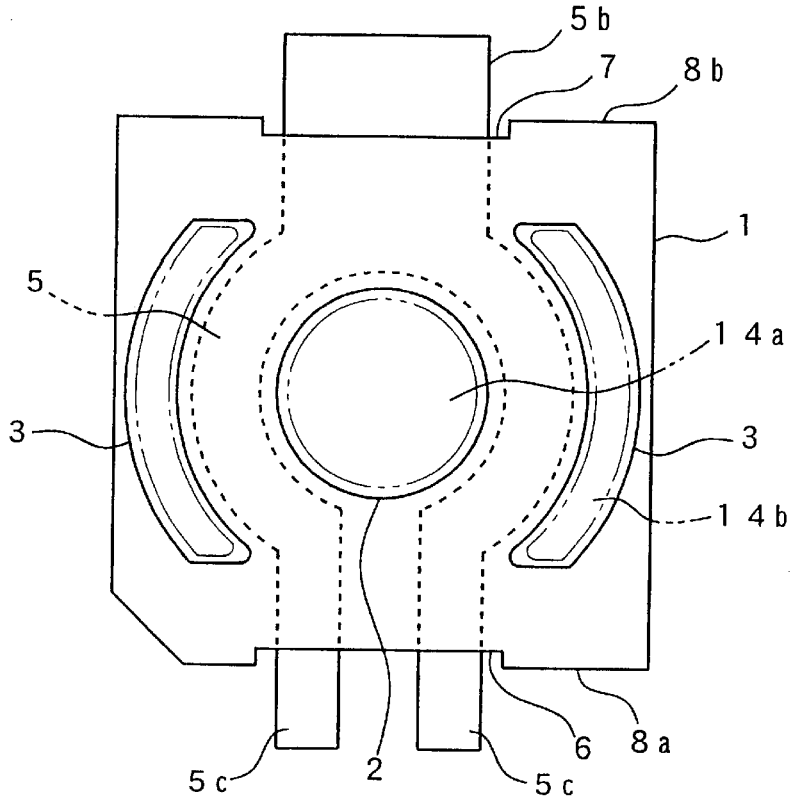
FIG. 1 is a plan view of a base in which a plate-like coil is buried according to an embodiment of the present invention.
Figure 3:
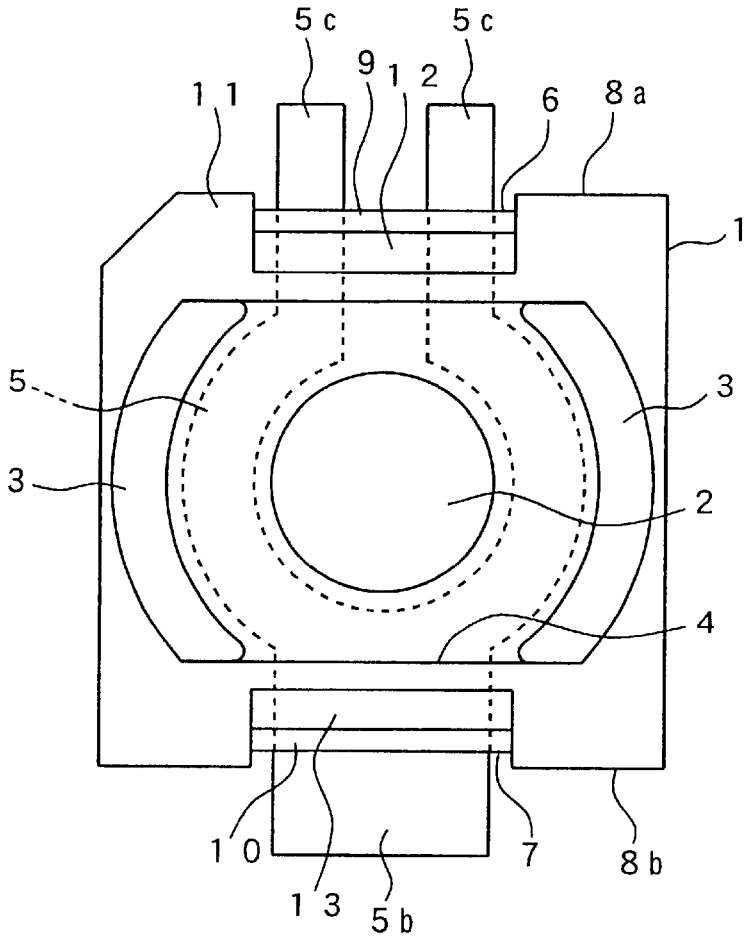
FIG. 3 is a bottom view of the base in which the plate-like coil is buried.

In FIG. 1, reference numeral 1 designates a base made from an insulating material such as a synthetic resin. The base 1 is formed into a flat shape, and has a through-hole 2 in which a central leg of an E-shaped core (which will be described later) is to be inserted, and two through-holes 3 in which side legs of the E-shaped core are to be inserted. As shown in FIG. 3, the back surface of the base 1 has a recess 4 in which the E-shaped core is to be inserted at the same level as that of the back surface of the base 1.

Figure 2:
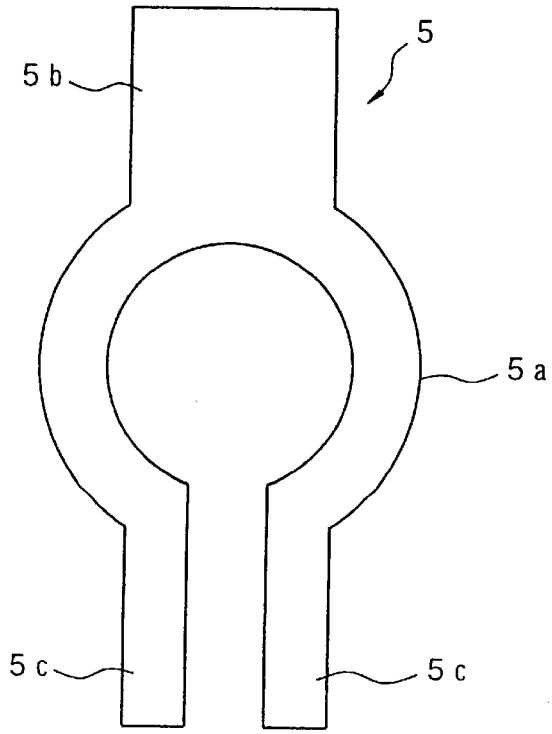
FIG. 2 is a plan view of the plate-like coil.

A plate coil 5 formed by a metal plate, typically, a hoop material is buried in the base 1 with its both ends projecting from the base 1. The base 1 and the coil 5 are thus formed into one body. As shown in FIG. 2, the plate coil 5, which is formed as a one-turn coil, has a coil portion 5*a* formed into a branched shape, and two electrode terminals 5*c* extending from branched legs of the coil portion 5*a*. The plate coil 5 also has a fixing terminal 5*b* extending from the coil portion 5*a* in the direction opposed to the electrode terminals 5*c*. These coil portion 5*a*, electrode terminals 5*c*, and fixing terminal 5*b* are formed by one metal plate into one-body. As a material of the plate coil 5, a known material can be adopted. The plate coil has an electric characteristic having a small inductance (L value) and allowed to carry a large current.

The coil portion 5*a* is formed into a curved shape for the plate coil 5 not to block the through-hole 2 and the through-holes 3 in the state in which the plate coil 5 is buried in the base 1. The through-hole 2 and the through-holes 3 are provided in the base 1 such that when the plate coil 5 is buried in the base 1, the through-hole 2 is aligned with a central space of the coil portion 5*a*, and the through-holes 3 are positioned along the outer edge of the coil portion 5*a*. The integral structure in which the coil 5 is buried in the base 1 can be manufactured by usual molding.

In the state in which the plate coil 5 is buried in the base 1, as shown in FIG. 1, the two electrode terminals 5*c* project from the side surface of the base 1, and the fixing terminal 5*b* projects from the opposed side surface of the base 1. These electrode terminals 5*c* and the fixing terminal 5*b* are, as will be described later, bent to be disposed on the bottom surface of the base. As shown in FIG. 3, a base side surface portion 6 located at a position corresponding to the bent position of the electrode terminals 5*c* (hereinafter, referred to as an "electrode terminal bent portion located side surface portion") is positioned inwardly from the remaining base side surface portion 8*a*, and a base side surface portion 7 located at a position corresponding to the bent position of the fixing terminal 5*b* (hereinafter, referred to as a "fixing terminal bent portion located side surface portion") is positioned inwardly from the remaining base side surface portion 8*b*.

Figure 9:
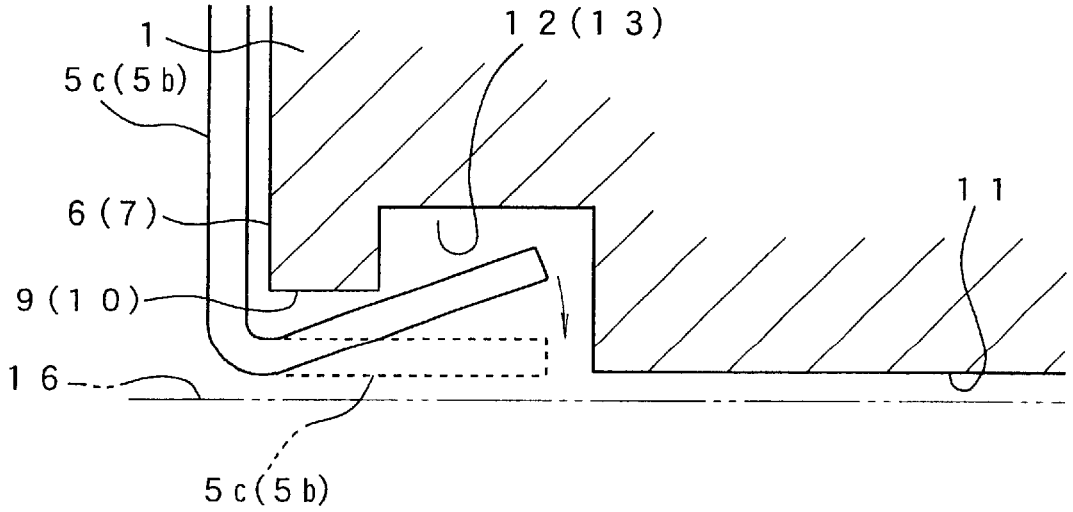
FIG. 9 is a schematic vertical sectional view showing a state in which an electrode terminal or a fixing terminal is bent on the bottom surface of the base.
Figure 10:
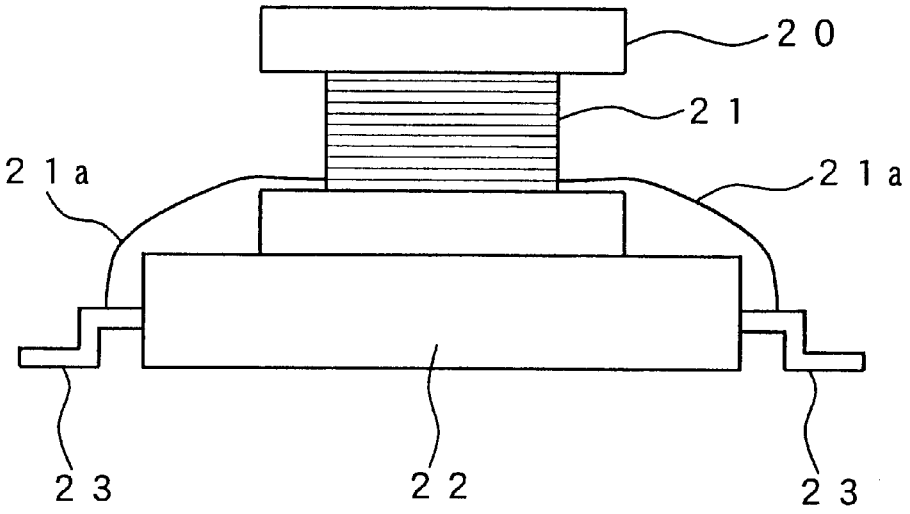
Fig. 10 PRIOR ART
FIG. 10 is a side view showing a related prior art inductance element.
Figure 11:
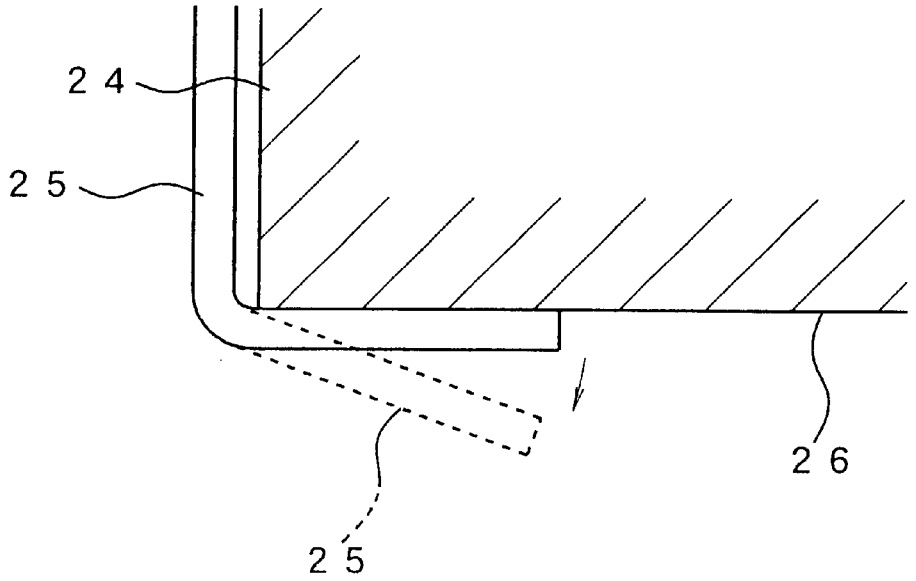
Fig. 11 PRIOR ART
FIG. 11 is a schematic vertical sectional view showing a terminal board bending state of the related prior art inductance element.

As shown in FIG. 9, a base bottom surface portion 9 located at a position corresponding to the bent position of the electrode terminals 5*c* (hereinafter, referred to as an "electrode terminal bent portion located bottom surface portion") is located at a position upwardly from the remaining base surface portion 11 (hereinafter, referred to as a "base bottom portion"), and a base bottom surface portion 10 located at a position corresponding to the bent position of the fixing terminal 5*b* (hereinafter, referred to as a "fixing terminal bent portion located bottom surface portion" is positioned upwardly from the remaining base surface portion (that is, the above-described base bottom portion 11).

As shown in FIGS. 3 and 9, recessed grooves 12 and 13 are formed between the electrode terminal bent portion located bottom surface portion 9 and the base bottom portion 11 and between the fixing terminal bent portion located bottom surface portion 10 and the base bottom portion 11, respectively.

Figure 4:
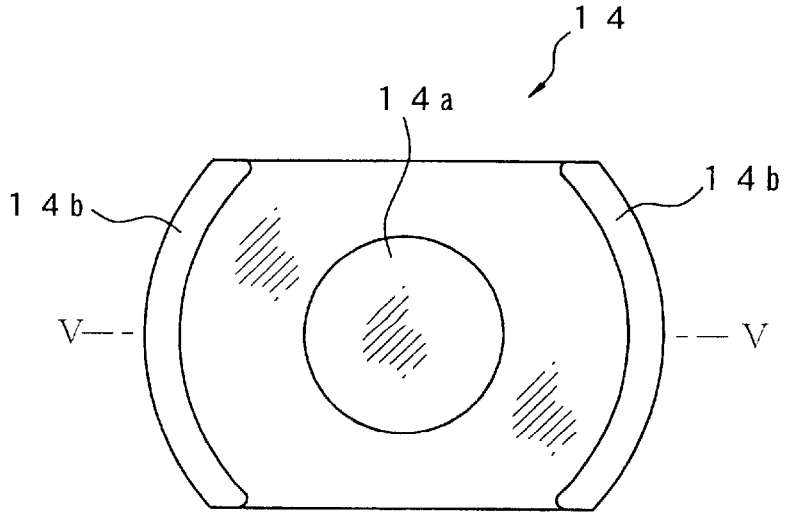
FIG. 4 is a plan view of an E-shaped core.
Figure 5:
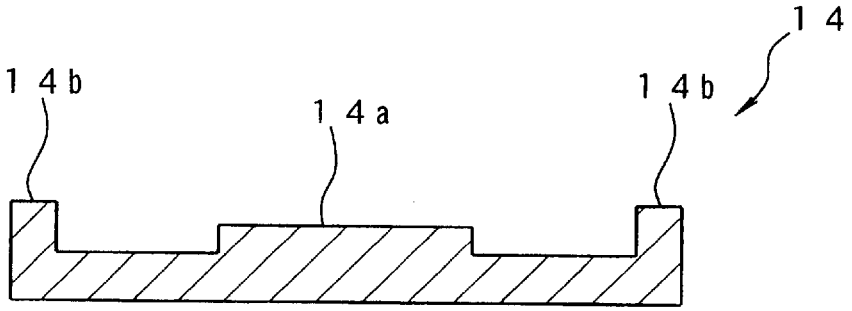
FIG. 5 is a vertical sectional view taken on line V—V of FIG. 4.
Figure 6:
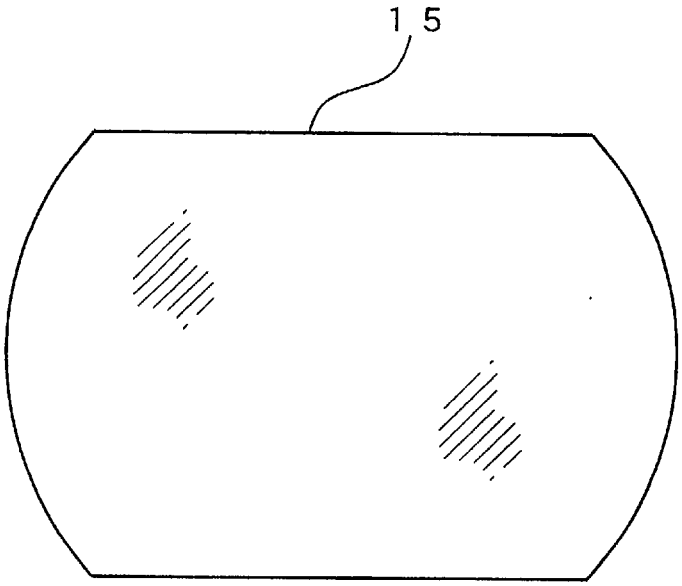
FIG. 6 is a plan view of an I-shaped core.

An E-shaped core 14 and an I-shaped core 15 functioning as a magnetic core are mounted on the base 1 in which the plate-coil 5 has been buried as described above. Each of the cores 14 and 15 is formed from a magnetic body, typically, a ferrite core. The E-shaped core 14 has, as shown in FIGS. 4 and 5, a central leg 14*a* and side legs 14*b*. The I-shaped core 15 is, as shown in FIG. 6, formed into a flat shape.

Figure 7:
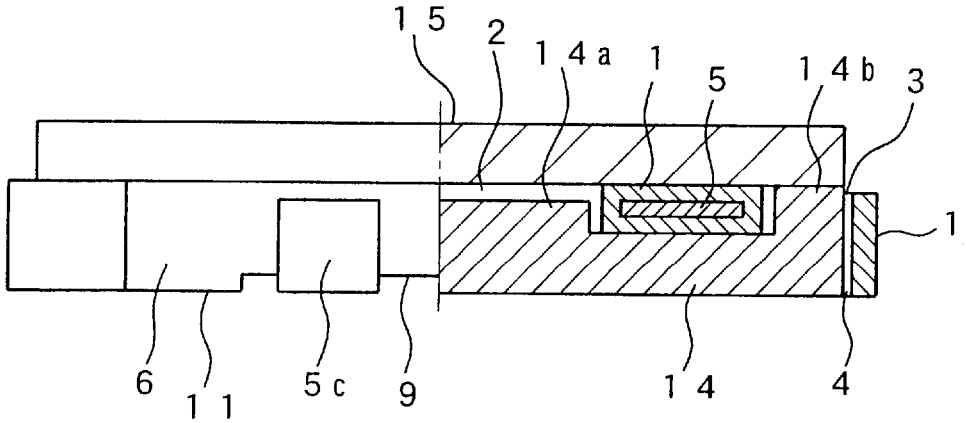
FIG. 7 is a front view, with an essential portion cutaway, showing the embodiment of an inductance element of the present invention.
Figure 8:
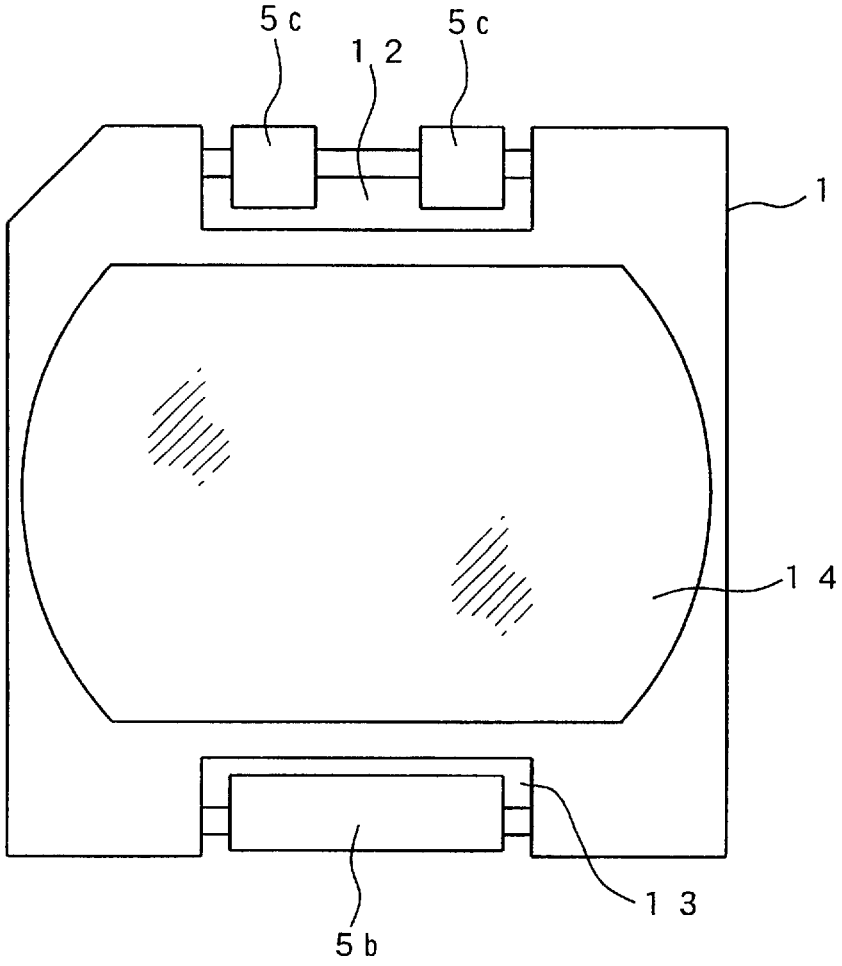
FIG. 8 is a bottom view of the inductance element shown in FIG. 7.

The E-shaped core 14 is mounted on the base 1 in such a manner as to be inserted in the recess 4 formed in the back surface of the base 1. As shown in FIGS. 1 and 7, the central leg 14*a* of the core 14 is fitted in the through-hole 2; the side legs 14*b* of the core 14 are fitted in the through-holes 3; and the core main body is fitted in the recess 4. Since the core main body is fitted in the recess 4, the core 14 does not project downwardly from the base 1, and more concretely, the bottom surface of the core 14 is at the same level as that of the bottom surface of the base 1.

The I-shaped core 15 is mounted on the E-shaped core 14, to constitute a pair of cores. As shown in FIG. 7, the I-shaped core 15 is mounted on the E-shaped core 14 in such a manner that the side edge portions of the I-shaped core 15 are in contact with the upper surfaces of the side legs 14*b* of the E-shaped core 14. The upper surfaces of the side legs 14*b* of the E-shaped core 14 are adhesively bonded to the side edge portions of the I-shaped core 15 by means of adhesive or the like.

The I-shaped core 15 is thus mounted on the E-shaped core 14 while holding the base 1 between the E-shaped core 14 and the same, whereby the plate coil 5 is held between the E-shaped core 14 and the I-shaped core 15 via the base 1, to form a closed magnetic path.

According to the present invention, a pair of cores are not limited to the combination of the E-shaped core and the I-shaped core but may be composed of a combination of an E-shaped core and another E-shaped core.

The electrode terminals 5*c* and the fixing terminal 5*b* projecting from the base 1 are bent downwardly to be disposed along the bottom surface of the base 1. The bent positions of the electrode terminals 5*c* and the fixing terminal 5*b* are arranged as shown in FIG. 9. Referring to FIG. 9, the electrode terminals 5*c* are bent at the position where the electrode terminal bent portion located bottom surface portion 9 and the recessed groove 12 are formed, and the fixing terminal 5*b* is bent at the position where the fixing terminal bent portion located bottom surface portion 10 and the recessed groove 13 are formed. To be more specific, the electrode terminals 5*c* and the fixing terminal 5*b* are 90° bent downwardly along the electrode terminal bent portion located side surface portion 6 and the fixing terminal bent portion located side surface portion 7, respectively, and the leading ends of the terminals 5*c* and 5*b* are further bent in the lateral direction along the electrode terminal bent portion located bottom surface portion 9 and the fixing terminal bent portion located bottom surface portion 10, respectively.

The above bending of the terminals 5*c* and 5*b* in the lateral direction is, more concretely, performed in such a manner that as shown in FIG. 9, each of the leading ends of the terminals 5*c* and 5*b* is bent at an angle of 90° or more (that is, at an angle allowing the bent side inner angle to be taken as an acute angle). Here, since the electrode terminal bent portion located bottom surface portion 9 and the fixing terminal bent portion located bottom surface portion 10 are both positioned upwardly from the base bottom portion 11 and further the recessed grooves 12 and 13 are respectively formed adjacent to the above bottom surface portions 9 and 10, each of the leading ends of the terminals 5*c* and 5*b* can be bent at an angle of 90° or more.

Each of the leading ends of the terminals 5*c* and 5*b* thus bent is displaced at an approximately horizontal position as shown by a dotted line in FIG. 9 by the spring back (that is, return by elasticity). As a result, the end portions of the electrode terminals 5*c* and the fixing terminal 5*b* bent on the bottom surface of the base 1 do not spring downwardly out of the base bottom portion 11, but are kept substantially at the same level as that of the base bottom portion 11.

According to the present invention, the end portions of the terminals 5*c* and 5*b* are not limited to be kept substantially at the same level as that of the base bottom portion 11 but may be positioned upwardly from the base bottom portion 11.

Since the end portions of the electrode terminals 5*c* and fixing terminal 5*b* do not spring downwardly out of the bottom surface of the base 1, the inductance element of the present invention can be fixedly supported in the horizontal direction upon mounting the inductance element on a circuit board 16, and the electrode terminals 5*c* and fixing terminal 5*b* can be rigidly bonded on circuit patterns of the circuit board 16 by soldering. The fixing terminal 5*b* is a false terminal not concerned with any electric effect but functions only as a means to be fixed to the circuit board 16. In this way, according to the present invention, since upon mounting the inductance element, the two electrode terminals 5*c* and one fixing terminal 5*b* are fixed on a conductive portion of the circuit board 16 by soldering, the inductance element can be rigidly mounted on the circuit board 16.

Upon mounting the inductance element, the base 1 may be fixed on the circuit board 16 via adhesive. While the fixing terminal 5*b* is fixed on the circuit board 16 by soldering as described above, it may be fixed on the circuit board 16 by means of adhesive.

While the fixing terminal 5*b* is provided on the plate coil in this embodiment, the present invention is not limited thereto but may be configured such that the fixing terminal 5*b* is not provided on the plate coil. To stably fix the inductance element on the circuit board, however, the fixing terminal 5*b* may be preferably on the plate coil.

According to the present invention, the electrode terminal bent portion located side surface portion 6 and fixing terminal bent portion located side surface portion 7 of the base 1 are positioned inwardly from the remaining base side surface portions 8*a* and 8*b*, respectively, and accordingly, upon bending the electrode terminals 5*c* and the fixing terminal 5*b* along the side surface of the base 1, the terminals 5*c* and 5*b* do not project from the remaining base side surface portions 8*a* and 8*b* respectively, so that the entire structure of the inductance element can be made compact. This is advantageous in terms of handling of the inductance element.

According to the present invention, since the plate coil 5 is integrated with the base 1 in the state being buried in the base 1, it is possible to make the entire thickness of the inductance element thinner.

Further, since the plate coil 5 is buried in the base 1, it is possible to ensure good insulation between the coil 5 and the coils 14 and 15.

What is claimed is:

1. An inductance element comprising:

a plate-like coil formed by a metal plate as one-turn coil, said coil having a coil portion formed into a branched shape and electrode terminals extending from a branched portion of said coil portion;

a base made from an insulating material, in which said plate-like coil is buried with said electrode terminals projecting therefrom, said base having through-holes which are insertion holes for legs of a core; and said core mounted in such a manner as to hold said base and thereby hold said plate-like coil buried in said base so as to form a closed magnetic path;

wherein said electrode terminals projecting from said base are bent on the bottom surface of said base;

an electrode terminal bent portion located at bottom surface portion of said base is formed in such a manner as to be positioned upwardly from a base bottom portion and a recessed groove is formed between said electrode terminal bent portion located at bottom surface portion and said base bottom portion; and said electrode terminals are bent at a position where said electrode terminal bent portion located at bottom surface portion and said recessed groove are formed.

2. An inductance element according to claim 1, wherein said base has a base side surface portion and an electrode terminal bent portion located at side surface portion positioned inwardly from said base side surface portion.

3. An inductance element according to claim 1, wherein said core, which holds said plate-like coil buried in said base, comprises an E-shaped core and an I-shaped core.

4. An inductance element according to claim 1, wherein said base has a through-hole for insertion of a central leg of said E-shaped core, and has a through-hole for insertion of side legs of said E-shaped core.

5. An inductance element according to claim 1, wherein said base has a recess for insertion of said E-shaped core.

6. An inductance element according to claim 1, wherein said plate-like coil has a fixing terminal extending from said coil portion;

said plate-like coil is buried in said base with said fixing terminal projecting from said base;

said base has a fixing terminal bent portion located at bottom surface portion positioned upwardly from a base bottom portion and a recessed groove formed between said fixing terminal bent portion located at bottom surface portion and said base bottom portion; and said fixing terminal projecting from said base is bent at a position where said fixing terminal bent portion located at bottom surface portion and said recessed groove are formed.

7. An inductance element according to claim 6, wherein said base has, at one side surface thereof, a base side surface portion and an electrode terminal bent portion located at side surface portion positioned inwardly from said base side surface portion, and also has, at the other side surface, a base side surface portion, and a fixing terminal bent portion located at side surface portion positioned inwardly from said base side surface portion.

* * * * *